US005738704A

United States Patent [19]

Dorofeev et al.

[11] Patent Number: 5,738,704

[45] Date of Patent: Apr. 14, 1998

[54] CHARGING STOCK FOR STEEL PRODUCTION

[75] Inventors: Genrikh Alekseevich Dorofeev, Tula; Serafim Zakharovich Afonin, Moscow; Anatolii Georgievich Sitnov, Tula, all of Russian Federation

[73] Assignee: Intermet-Service and Company, Tula, Russian Federation

[21] Appl. No.: 588,111

[22] Filed: Jan. 18, 1996

[30] Foreign Application Priority Data

May 26, 1995 [RU] Russian Federation ..... 95108413

[51] Int. Cl.[6] ..... C21B 3/02

[52] U.S. Cl. ..... 75/304; 75/316; 75/572

[58] Field of Search ..... 75/316, 572, 304

[56] References Cited

U.S. PATENT DOCUMENTS

| | | | |
|---|---|---|---|
| 2,710,796 | 6/1955 | Pinkerton | 75/25 |
| 3,948,612 | 4/1976 | Schulten-Baumer | 75/572 |
| 4,564,388 | 1/1986 | Vallomy | 75/12 |
| 4,581,068 | 4/1986 | Schramm | 75/130 R |
| 4,797,154 | 1/1989 | Benedetti et al. | 75/46 |
| 4,957,546 | 9/1990 | Lazcano-Navarro | 75/529 |
| 5,364,441 | 11/1994 | Worner | 75/10.1 |
| 5,425,797 | 6/1995 | Dorofeev et al. | 75/306 |
| 5,562,753 | 10/1996 | de Lassat de Pressigny et al. | 75/10.63 |

*Primary Examiner*—Melvyn Andrews
*Attorney, Agent, or Firm*—Heller Ehram White & McAuliffe

[57] ABSTRACT

An improved charging stock for steel production which facilitates earlier and more uniform carbon oxidation, and increases the rate of oxygen transport in the melt, comprises and iron-carbon alloy having silicon therein and an oxide-containing material. The iron-carbon alloy preferably has a ratio of carbon to silicon in the range of approximately 4–40:1. The ratio of oxide-containing material surface area to the weight of the iron-carbon alloy is preferably maintained in the range of 5–100 $m^2$/ton.

7 Claims, 2 Drawing Sheets

CHARGING STOCK FOR STEEL PRODUCTION

FIELD OF THE INVENTION

The present invention relates in general to ferrous metallurgy, and more particularly to an improved charging stock used in the production of steel.

BACKGROUND OF THE INVENTION

Casting machines for casting pigs with a filler (such as an oxide material) are well know in the art. Such machines typically function as follows: Pellets are charged into the casting machine in automated containers approximately 1 $m^3$ (in volume), raised by telphers and subsequently loaded into bins. A ladle, containing molten iron, is fed to the casting machine and tilted by a manipulator. Molten iron is then poured from a ladle into the casting machine, which is ultimately fed into ingot molds.

Casting machine feeders are then lowered into working position (commonly, to a stop in the ingot molds), the gates opened, and the pellets discharged through the supply system into the ingot molds (charging boxes). The conveyer drive is then turned on. As the conveyers move, the feeders level out the pellets in the ingot molds. The ingot molds, filled with pellets, move into position and are filled with iron.

A major drawback of the charge material produced by the above method is the low rate of carbon oxidation. The low carbon oxidation rate typically results from the presence of a relatively low rate of oxygen supply due to the under-development of the oxide material-base metal (e.g., iron-carbon alloy) interface. This deficiency is especially noticeable at the start of melting, when the bath has a reduced temperature. The under-development of the interphase surface and the low temperatures inhibit the oxidation of carbon.

Another drawback of the charge material is the pronounced nonuniformity of the carbon oxidation rate and, in many instances, the complete suspension of this reaction due to the preferential oxidation of silicon. Under conditions where there is insufficient oxidizing agent, the silicon draws the available oxygen for its own oxidation, inhibiting or entirely terminating the oxidation of carbon. The absence of a controlled ratio of carbon to silicon in the conventional charge material thus leads to a wide spread in the rates of decarborization and carbon content upon melting.

Therefore, what is needed is an improved charging stock for metallurgical processing that (i) facilitates earlier and more uniform oxidation of carbon and (ii) attains a high rate of decarborization at low bath temperatures.

SUMMARY OF THE INVENTION

The present invention substantially reduces or eliminates the disadvantages and shortcomings associated with prior art charge materials. The invention provides an improved charging stock for metallurgical processing that facilitates earlier and more uniform oxidation of carbon during the melting process. The charging stock also increases the rate of oxygen transport in the melt.

Accordingly, it is an object of the present invention to provide a charging stock for metallurgical processing which facilitates earlier and more uniform oxidation of carbon.

It is another object of the present invention to provide a charging stock for metallurgical processing which attains a high rate of decarborization at low bath temperatures.

It is another object of the present invention to provide a charging stock for metallurgical processing which enhances the stability of the carbon content during the melting process.

It is yet another object of the present invention to provide a charging stock for metallurgical processing which increases the rate of oxygen transport during the melting process.

In accordance with the above objects and those that will be mentioned and will become apparent below, the improved charging stock in accordance with this invention comprises an iron-carbon alloy having silicon therein and an oxide-containing material. The iron-carbon alloy preferably has a ratio of carbon to silicon in the range of 4–40:1. The ratio of the oxide-containing material surface area to the weight of the iron-carbon alloy is preferably maintained in the range of 5–100 $m^2$/ton.

The advantages of this invention are (i) earlier oxidation of the carbon by the oxygen of the oxide material, (ii) high rates of decarborization at the low bath temperatures (~1250°–1300° C.), (iii) more uniform oxidation of carbon during the melting process, and (iv) enhanced stability of the carbon content during the melting process.

BRIEF DESCRIPTION OF THE DRAWINGS

Further features and advantages of the improved charging stock for metallurgical processing disclosed herein will become apparent from the following and more particular description of the preferred embodiment of the invention as illustrated in the accompanying drawings in which.

DESCRIPTION OF PREFERRED EMBODIMENTS

Figure 1:
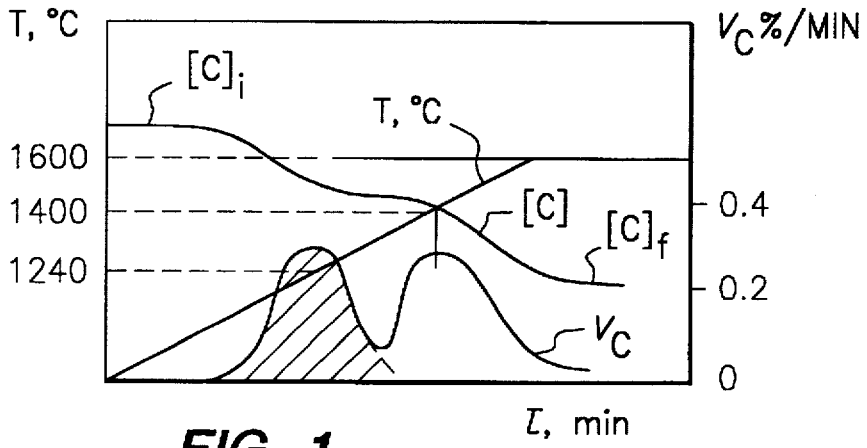
FIGS. 1–3 are graphical illustrations of the change in carbon content as a function of the carbon oxidation rate for various ratios of the external surface area of the oxide-containing material to the weight of iron-carbon alloy according to the invention.

The improved charging stock of the present invention comprises an iron-carbon alloy and an oxide-containing material. The charging stock is produced by conventional methodology, preferably, by pouring molten iron-carbon alloy over "lump" oxide-containing material. According to the invention, various oxide-containing materials may be employed within the scope of this invention. For example, the oxide-containing materials my comprise iron ore pellets, iron ore, metal concentrates, scale, agglomerate, pulverized waste, sludge from metallurgical processes and mixtures thereof.

A key characteristic of the improved charging stock of the invention is the use of oxide-containing materials which have a larger surface area than that commonly employed in prior art materials. According to the invention, the ratio of the external surface area of the oxide-containing material to the weight of the iron-carbon alloy is preferably in the range of 5–100 $m^2$/ton. As will be recognized by one having ordinary skill in the art, knowing the initial granulometric composition of the oxide-containing material and its relative amount in the charging stock, one can easily obtain the ratio set forth above.

Another key characteristic of the charging stock of the invention is that the ratio of silicon to carbon in the iron-carbon alloy is preferably maintained in the range of 4–40:1. The specified ratio is preferably maintained by varying the silicon content in the iron-carbon alloy, since it is technically more difficult to control the carbon concentration in high carbon melts.

Given the same composition of the charging stock and a constant ratio of its principal components—the oxide-containing material and iron-carbon alloy—increasing the surface area of the oxide-containing material will substantially increase the specific surface per unit mass of the iron-carbon alloy.

Further, the amount of oxygen that is supplied to the base metal (i.e., the iron-carbon alloy of the charging stock) generally increases in proportion to the increase in surface area of the oxide-containing material. Thus, the presence of carbon in the base metal enables it to melt at relatively low temperatures (~1170°–1200° C.),which is generally below the bath temperatures during the initial period of converter and electric melting. This ensures a high rate of carbon transport in the base metal, even at the start of melting when the bath is still cold, thereby eliminating carbon mass transport as a factor limiting the oxidation of carbon. As a result, optimum conditions (discussed below) for accelerated oxidation of the carbon are created.

The first condition created by the charging stock of the invention is the formation of a highly developed phase contact surface between the solid oxide-containing material and the molten iron-carbon alloy. According to the invention, a maximum value (~90–100 $m^2$/ton) of the ratio of the external surface area of the oxide-containing material to the weight of the iron-carbon alloy is also required. This sharply intensifies oxygen transport to the carbon reaction front and eliminates (from the rate of carbon oxidation) the constraints imposed by the stage of oxygen supply on the resulting (total) carbon oxidation rate.

The second condition for accelerated oxidation of carbon that is created by the charging stock of the invention is the reduced melting point of the iron-carbon alloy base, attained through the presence of carbon. According to the invention, the iron-carbon alloy melts at an initial bath temperature in the range of 1200°–1300° C. This ensures the required rate of carbon supply to the interface of the oxide-containing material at temperatures substantially below the melting point of the charging stock, the melting point of iron, and the final temperature of the metal at the outlet.

The noted conditions ensure the early commencement of carbon oxidation at the reduced temperatures of the metal bath even while the source of oxygen supply—the oxide-containing material—it is in the solid state, i.e., at temperatures below the melting point of the solid oxidizing agent. Oxidation of carbon in the low-temperature region also occurs at elevated rates, characteristic of the case where liquid iron is blown with gaseous oxygen. Physically, this means that the decrease in the rate of oxygen supply from solid oxide-containing material due to the low rate of oxygen diffusion in the solid is compensated by the large surface of the solid and by shortening the path of oxygen diffusion to the site of the carbon reaction.

In contrast to conventional charge materials where the rate of oxygen sharply limits the carbon oxidation, the stage that limits the carbon oxidation in the charging stock of the invention is the rate of heat supply to the charging stock and the melting rate. The sharp increase in the phase interface between the oxide-containing material and the iron-carbon alloy melt, under conditions where the alloy has already fused and is adequately heated, eliminates the stage of oxygen supply as a limiting factor. A new factor, the thermal factor, specifically, the melting rate of the charging stock, is now the limiting factor. This means that diffusion kinetics, which govern the rate of transport of the oxygen flow, gives way as a limiting factor to the rate of heat exchange between the charging stock and the environment, i.e., to heat transfer.

According to the invention, the presence of a developed specific surface area (the ratio of the external surface of the oxide-containing material to the weight of the iron-carbon alloy) in the range 5–100 $m^2$/ton facilitates the commencement of carbon oxidation with relatively high rates, even in the early stages of the heat when the bath is still relatively cold. Moreover, this oxidation takes place in the presence of the silicon contained in the iron-carbon alloy.

If the specific surface area at the interface between the oxide-containing material and the iron-carbon alloy is less than 5 $m^2$/ton, the rate of increase of the oxygen supply is relatively low, producing an oxygen deficiency. In this case, oxidation of silicon, which has a much stronger affinity for oxygen than carbon, predominantly develops. As a result, the carbon is not oxidized sufficiently, which reduces the effectiveness of the material.

If the specific surface area is larger than 100 $m^2$/ton, oxidation of carbon proceeds at an excessive rate. Consequently, the heating rate of the base metal lags behind the rate of decarborization, since the oxidation of carbon by solid iron oxides is accompanied by heat expenditures and cooling of the bath. As heating professes and the bath temperature rises, the oxidation of carbon is likely to become cyclic in character and lead to ejections and entrainment of metal particles during the turbulent gas release by the reaction products from the oxidation of carbon.

Thus, according to the invention, the optimum and, therefore preferred ratio of external surface area of oxide-containing material to the weight per unit mass of the iron-carbon alloy is in the range of 5–100 $m^2$/ton.

As stated above, according to the invention, the ratio of the carbon to silicon in the iron-carbon alloy is maintained in the range of 4–40:1. The noted ratio is preferred since oxidation of both carbon and silicon is attained in this range.

If the ratio of carbon to silicon is less than 4:1, silicon oxidizes predominantly and forms a reaction product in the form of high-melting silicon dioxide. This high-melting phase blocks the interface between the oxide-containing material and the molten iron-carbon alloy, hindering the supply of both oxygen and carbon to the reaction fronts. Consequently, the oxidation of carbon is abated.

If the ratio of carbon to silicon is greater than 40:1, carbon predominantly oxidizes until the C/Si ratio reaches equilibrium values corresponding to this temperature. At this point, there is no heat release in the reaction zone. In view of the endothermic nature of the oxidation of carbon by solid oxidizing agents, the oxidation of carbon slows or even abated. Consequently, the melting time is lengthened.

Referring to Table 1, there is shown the results of experimental melts of the charging stock of the invention in an electric furnace.

TABLE 1

| Composition of pig charge | | | Heats in experimental electric furnaces Rate of oxidation of |
|---|---|---|---|
| Item No. | Ratio of external surface are of oxide-containing material to weight of iron-carbon alloy | Ratio of carbon to silicon in iron-carbon alloy | carbon at reduced temperatures in initial melting period, %/min |
| Prior art | 3.0 | 5.0 | 0.2 |
| 1 | 5 | 4.5 | 0.27 |
| 2 | 50.0 | 6.0 | 0.4–0.5 |
| 3 | 75.0 | 12.2 | 0.5–0.6 |
| 4 | 100.0 | 25.6 | 0.6–0.8 |

Figure 2:
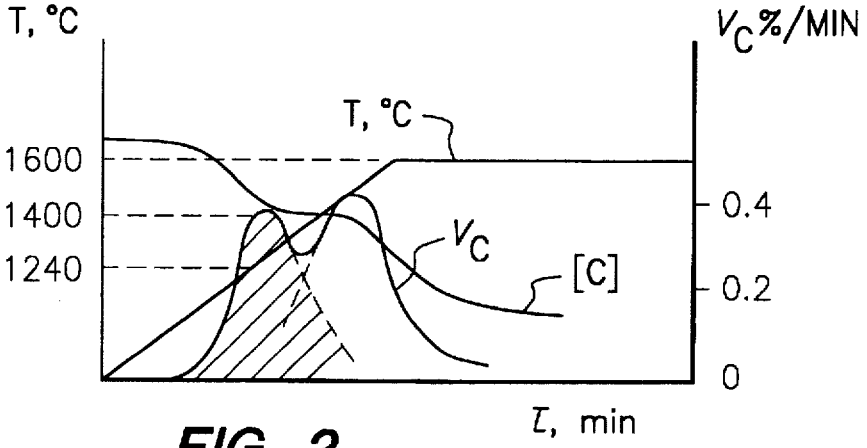
Figure 3:
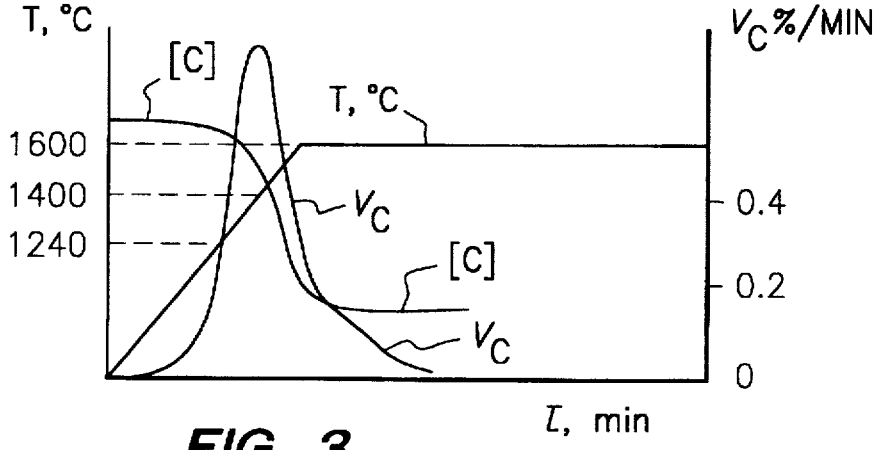

The change in carbon content ([c], %) in the charging stock and the rate of carbon oxidation ($V_c=\partial[c]/\partial\tau$, %/min) was recorded for different ratios oft he external surface area of the oxide-containing material to the weight of the iron-carbon alloy (see FIGS. 1, 2, and 3).

Referring to FIG. 1, there is shown the change in carbon content ([c], %) in the charging stock (from C initial, $[C]_i$, to C final, $[C]_f$) as a function of the carbon oxidation rate ($V_c=\partial[c]/\partial\tau$, %/min) when the ratio of the external surface area of the oxide-containing material to the weight of the iron-carbon alloy is 5 $m^2$/ton.

FIGS. 2 and 3 graphically illustrate the results of the ratio of external surface area of oxide-containing material to the weight of the iron-carbon alloy of 35 $m^2$/ton and 100 $m^2$/ton, respectively.

As illustrated in FIGS. 1–3, as the heating rate of the given charging stock increases (with increasing ratio of the external surface area of the oxide-containing material to the weight of the iron-carbon alloy), the nature of the carbon oxidation changes. At low ratios of external surface area of the oxide-containing material to weight of the iron-carbon alloy (See FIG. 1), the rate of carbon oxidation has two pronounced peaks: one at 1240° C., and the other at 1400° C. The first peak corresponds to the point of initial melting of the pig iron and carbon oxidation in the liquid iron by the oxygen in the solid pellets. At this point the charge material is in a solid-liquid state while preserving the original structure. The solid pellets are then covered with a film of silicon dioxide (due to the oxidation of the silicon in the pig iron) and the carbon oxidation reaction slows. As the temperature rises to ~1400° C., the base of the pellets (hematite gains) melts and the reaction reaccelerates. However, conventional carbon oxidation in the liquid iron (via the oxygen contained in the ferruginous slag) is already proceeding.

If the ratio of the external surface area of the oxide-containing material to the weight of the iron-carbon alloy is 35 $m^2$/ton, the heating rate increases, the peaks reflecting the carbon oxidation rate converge and, at high heating rates (See FIG. 3), merge. The absolute value of the carbon oxidation rate is approximately 0.2–0.8%/min under these conditions, which is approximately double the maximum rates of carbon oxidation in a basic oxygen furnace.

Under laboratory conditions, when the ratio of the external surface of the oxide-containing material to the weight of the iron-carbon alloy is approximately 100 $m^2$/ton, the melt boils up energetically and the volume of the slag-metal-gas emulsion increases. Thus, a timber distinctive characteristic of the charging stock of the invention is the presence of a first period of carbon oxidation: oxidation of the carbon in the pig iron by the oxygen in the solid pellets. The three-dimensional structure of the charging stock is basically preserved in this case, ensuring a high specific surface of reaction.

In further experiments conducted by Applicants in a basic oxygen furnace, a charging stock based on basic pig iron (78–83 wt. %) and iron-ore pellets (17–22%) with a (5–20):1 ratio of the external surface of the iron-ore pellets to the weight of the iron was employed. The content of ore pellets was chosen so that the amount of oxygen in the pellets would be less than the stoichiometric value corresponding to the reaction of complete oxidation of the carbon in the charging stock.

The chemical composition (calculated) of one exemplar composition of the charging stock (20% pellets by weight) is presented below (in percent):

| Fe met. | FeO | $Fe_2O_3$ | $SiO_2$ | $Al_2O_3$ | CaO | MgO | MnO | $Na_2O$ |
|---|---|---|---|---|---|---|---|---|
| 74.540 | 0.630 | 17.534 | 1.712 | 0.004 | 0.730 | 0.089 | 0.015 | 0.003 |
| $K_2O$ | C | Si | Mn | Cr | Cu | Ni | P | S |
| 0.013 | 3.712 | 0.635 | 0.277 | 0.015 | 0.007 | 0.009 | 0.057 | 0.018 |

As will be recognized by one having ordinary skill in the art, the amount of oxygen in the charging stock that is employed for oxidation of the carbon and silicon is approximately 87.5% of the mass required for the reactions (See Table 2).

TABLE 2

Oxygen Inflows and Distributions for Oxidation of Carbon and Silicon of the Charging Stock (Weight of Charging Stock Is 1 ton)

| Oxygen in iron oxides, kg | Oxygen consumption for reactions, kg | Amount of oxygen from bath and blowing that goes into reactions, kg |
|---|---|---|
| FeO (0.630/100) × (16/72) × 1000 = 1.4 kg | C—CO 0.9* × (3712/100) × (16/12) × 1000 = 44.544 kg | 61.699–54.002 = 7.697 kg |
| FeO (17.534/100) × (48/160) × 1000 = 52.602 kg | C—$CO_2$ 0.1 × (3.712/100) × (32/12) × 1000 = 9.898 kg | |
| | Si—$SiO_2$ (0.635/100) × (32/28) × 1000 = 7.257 kg | |
| TOTAL: 54.002 kg | TOTAL: 61.699 kg | |

*0.9 is the fraction of the carbon that goes to CO.

TABLE 3

Content of Residual Elements in Isotropic Electrical Steel as a Function of Charge Composition, and the Yield of Higher Steel Brands

| Charge composition, % | Content of elements, % | | | Yield of higher steel brands, % | | |
|---|---|---|---|---|---|---|
| production period) | Cr | Ni | Cu | 2212, 2215, 2216, GOST [USSR State Standard] 21427.2-83 | 2312, GOST 21427.2-83, 23.15 Technical Specifications TU 14-106-335-89 | 2412, 2413, 2414, 2415, GOST 21427.2-83 |
| Liquid iron 79.1<br>Scrap 20.9 | 0.037 | 0.046 | 0.064 | 76.2 | 72.5 | 55.0 |
| Liquid iron 83.1<br>Scrap 16.9 | 0.029 | 0.31 | 0.038 | 84.7 | 74.2 | 68.7 |
| Liquid iron 90.3<br>Scrap 6.0<br>Superkom 3.7 | 0.022 | 0.027 | 0.026 | 90.6 | 91.6 | 85.0 |

With the noted distribution of oxygen (for carbon oxidation reactions), when some of the oxygen (~10–15% of the oxygen involved in the reactions) evolves from the liquid bath during blowing, the process of oxygen buildup in the converter bath is virtually eliminated. By virtue oft he melting point of the charging stock (~1200°–1250° C.), which is lower than that of the scrap, the process of decarborization of the bath begins earlier and initially proceeds inside the charging stock being melted, with evolution of carbon monoxide.

Figure 4:
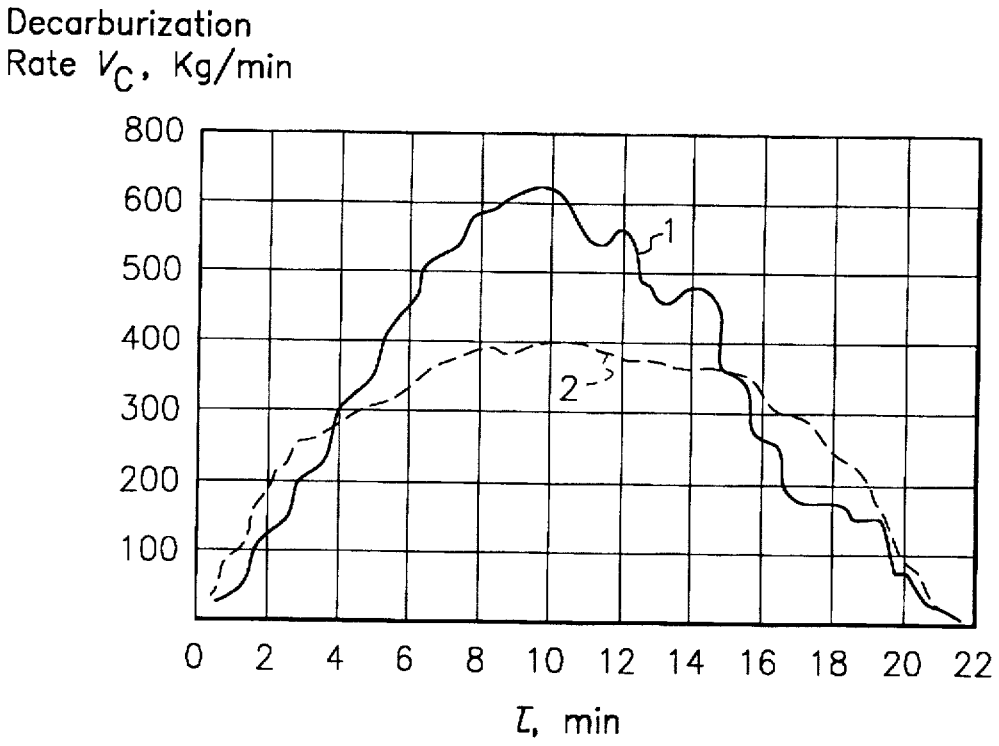
FIG. 4 is a graphical illustration of the decarborization rate as a function of time for the charging stock according to the invention and a conventional charge material.

Further, as illustrated in FIG. 4, the use of the charging stock of the invention (denoted 2) accelerates the oxidation of carbon in the first cold period of the heat by approximately 25–100%. At the end of this period (~4 min) the rates of carbon oxidation of the charging stock 2 and the conventional charge material 1 are approximately equal, and from this time forward the oxidation of carbon proceeds more uniformly than with the conventional charge material. In this instance, by virtue of the use of the improved charging stock, peak gas releases are eliminated, thermal loads on the equipment of the boiler-cooler are lowered, and entrainment and metal-coating of boiler elements are reduced.

The cooling effect of the charging stock of the invention is also close to that of scrap. Therefore, as will be recognized by one having ordinary skill in the art, when the charging stock is introduced into the metal heat the consumption of coolant additives can be determined with relative ease. Replacing conventional scrap with the charging stock of the invention in a 1:1 ratio thus leads to essentially no change in the thermal balance of the heat.

The charging stock of this invention thus makes it possible to reduce the content of residual elements in isotropic electrical steel and to increase the yield of higher steel brands (see Table 3) when the stock is used as a replacement for metal scrap in the burden of a converter.

As will be recognized by one having ordinary skill in the art, several key advantages can be realized through the use of the improved charging stock of the invention. The advantages include the advanced creation of a highly developed surface on the oxide-containing material. This sharply accelerates the oxygen supplied to the carbon reaction front. The increase in the rate of oxygen transport is so significant that it ceases to limit the reaction of carbon oxidation. The reaction is thus limited by the rate of heating and melt-down of the charging stock.

An additional advantage of the charging stock is that early oxidation of carbon is ensured at the start of the heat at reduced bath temperatures (1200°–1300° C.). Moreover, extremely high values of carbon oxidation rates at reduced temperatures—values corresponding to conditions under which pig iron is blown with oxygen (0.2–0.4% C/min)—can be attained.

Finally, the presence of excess oxygen at the interface between the oxide-containing material and the iron-carbon alloy melt as a result of the large surface area of the oxide-containing material, the high oxygen concentration in the oxide-containing material and its activity facilitate the simultaneous, parallel oxidation of all elements that, under these conditions, have a greater affinity for oxygen than iron, including carbon and silicon. This substantially reduces or eliminates the dependence of the percent carbon oxidation on the silicon content in the iron-carbon alloy, especially at reduced temperatures.

What is claimed is:

1. A composite charging stock for metallurgical processing, comprising:

an iron-carbon alloy, said alloy including silicon; and an oxide containing material, the ratio of the external surface area of said oxide-containing material to the mass of said iron-carbon alloy being in the range of 5–100 $m^2$ per ton.

2. The composite charging stock of claim 1 where the ratio of carbon to silicon in said iron-carbon alloy is in the range of 4–40:1.

3. The composite charging stock of claim 1 wherein said iron-carbon alloy comprises pig iron.

4. The composite charging stock of claim 1 wherein said oxide-containing material comprises iron ore pellets, iron ore, metal concentrates, scale, agglomerate, pulverized wastes, sludge from metallurgical processes or mixtures thereof.

5. A composite charging stock for metallurgical processing, comprising:

an iron-carbon alloy, said alloy including silicon, the ratio of carbon to silicon in said iron-carbon alloy being in the range of 4–40:1; and an oxide containing material, the ratio of the external surface area of said oxide-containing material to the mass of said iron-carbon alloy being in the range of 5–100 $m^2$ per ton.

6. The composite charging stock of claim 5 wherein said iron-carbon alloy comprises pig iron.

7. The composite charging stock of claim 5 wherein said oxide-containing material comprises iron ore pellets, iron ore, metal concentrates, scale, agglomerate, pulverized wastes, sludge from metallurgical processes or mixtures thereof.

* * * * *